United States Patent [19]

Sherman

[11] Patent Number: 4,966,371

[45] Date of Patent: Oct. 30, 1990

[54] BOARD GAMES OF EMOTIONAL EXPRESSION

[76] Inventor: Jimmy L. Sherman, 1743 E. 122nd St., Los Angeles, Calif. 90059

[21] Appl. No.: 436,010

[22] Filed: Nov. 13, 1989

[51] Int. Cl.[5] ..... A63F 3/00

[52] U.S. Cl. ..... 273/243; 273/146

[58] Field of Search ..... 273/243, 248, 249, 256, 273/278, 146

[56] References Cited

U.S. PATENT DOCUMENTS

| | | | |
|---|---|---|---|
| 4,013,294 | 3/1977 | Smeda et al. | 273/243 X |
| 4,216,594 | 8/1980 | Farley et al. | 273/243 X |
| 4,216,971 | 8/1980 | Lyke | 273/243 |
| 4,815,976 | 3/1989 | Krane | 273/243 |
| 4,893,819 | 1/1990 | Wright | 273/243 |
| 4,907,807 | 3/1990 | Lee et al. | 273/243 X |

*Primary Examiner*—Edward M. Coven
*Assistant Examiner*—William E. Stoll
*Attorney, Agent, or Firm*—Erik M. Arnhem

[57] ABSTRACT

A game in which each player advances a token around a game board between a "start" space and a "finish" space. Markings on some of the board spaces require a player landing on the space to either select a card from a stack of cards or to roll three fortune dice. These cards and dice present messages directing the player to successfully express certain emotions (cry, laugh, smile, etc.) or in the alternative pay play money to the other players. The winner is the player having the most play money, when one player reaches the appropriate "finish" space.

9 Claims, 5 Drawing Sheets

FIG. 3.
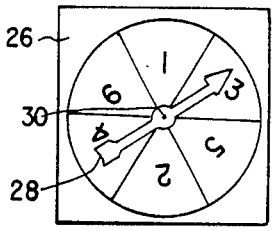
FIG. 2.
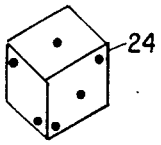
FIG. 4a.
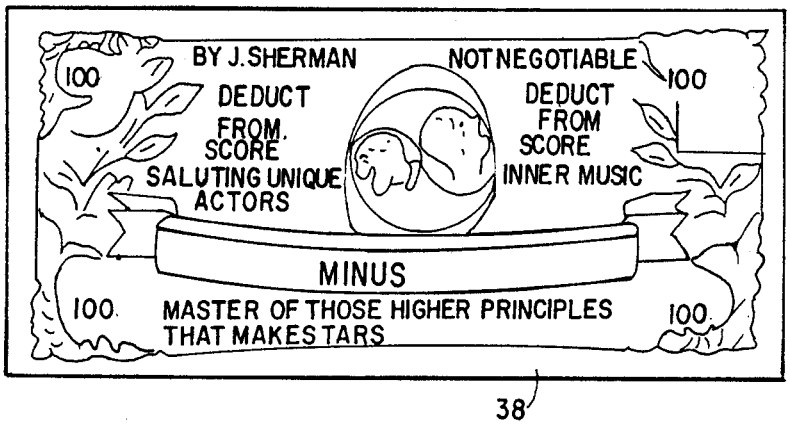
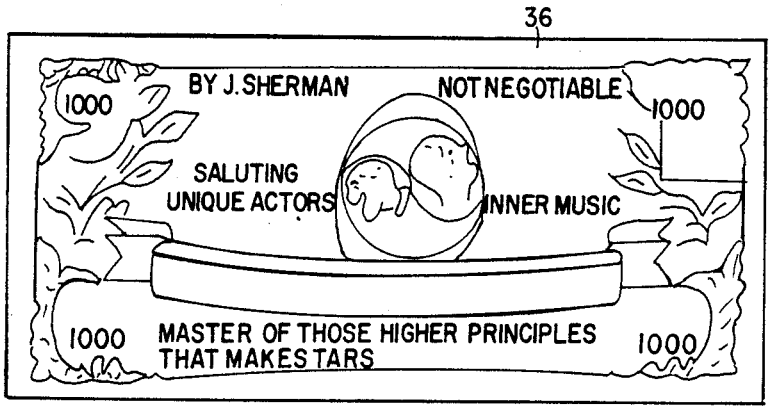
FIG. 4b.
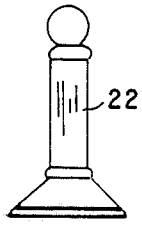
FIG. 5.

BOARD GAMES OF EMOTIONAL EXPRESSION

BACKGROUND AND SUMMARY OF THE INVENTION

This invention relates to a game designed to induce the players to express an emotion (such as laughter, sadness or crying) or to display verbal dexterity in reading a tongue twister expression. The game can be played by two, three or four people.

The game apparatus includes a square board having spaces marked off along its edges. Each player individually (in turn) moves a position identifier piece from space-to-space, between a starting point on the board and a finish point on the board. The number of spaces moved during each turn is determined by an appropriate manually-actuable device subject to the rules of chance, e.g. a die or a spinable arrow device.

Selected spaces on the board have instructions printed thereon directing the player landing on that space to either pull a card from a stack of cards positioned on the game board, or to roll three fortune dice. These cards and fortune dice in turn have instructions printed thereon directing the player to express certain emotions (e.g. laughter, sadness or joy) or to read a tongue-twister expression. If the player refuses or fails to successfully comply with the instructions he/she is required to forfeit a specific sum of play money.

At the start of the game each player is given a specific amount of play money, e.g. $750. During the course of the game each player will at times receive money from the other players; at other times he/she will be forced to give money to the other players. The game ends when one player completes one circuit of the board, i.e. moves his or her position-identifier piece from the start space around the board to a finish space on the board. The winner is the person having the most money at the end of the game. The winner may, or may not be, the person who completes the circuit around the board.

THE DRAWINGS

FIG. 2 is a view of a die used with the game board of FIG. 1.

FIG. 3 is a plan view of a spinner device that may be used instead of the die shown in FIG. 2.

FIGS. 4 and 4A show two types of play money that can be used in playing the game (when the FIG. 1 game board is employed).

FIG. 5 is an elevational view of a player-position identifier piece usable with the FIG. 1 game board.

DESCRIPTION OF A PREFERRED EMBODIMENT OF THE INVENTION

Figure 1:
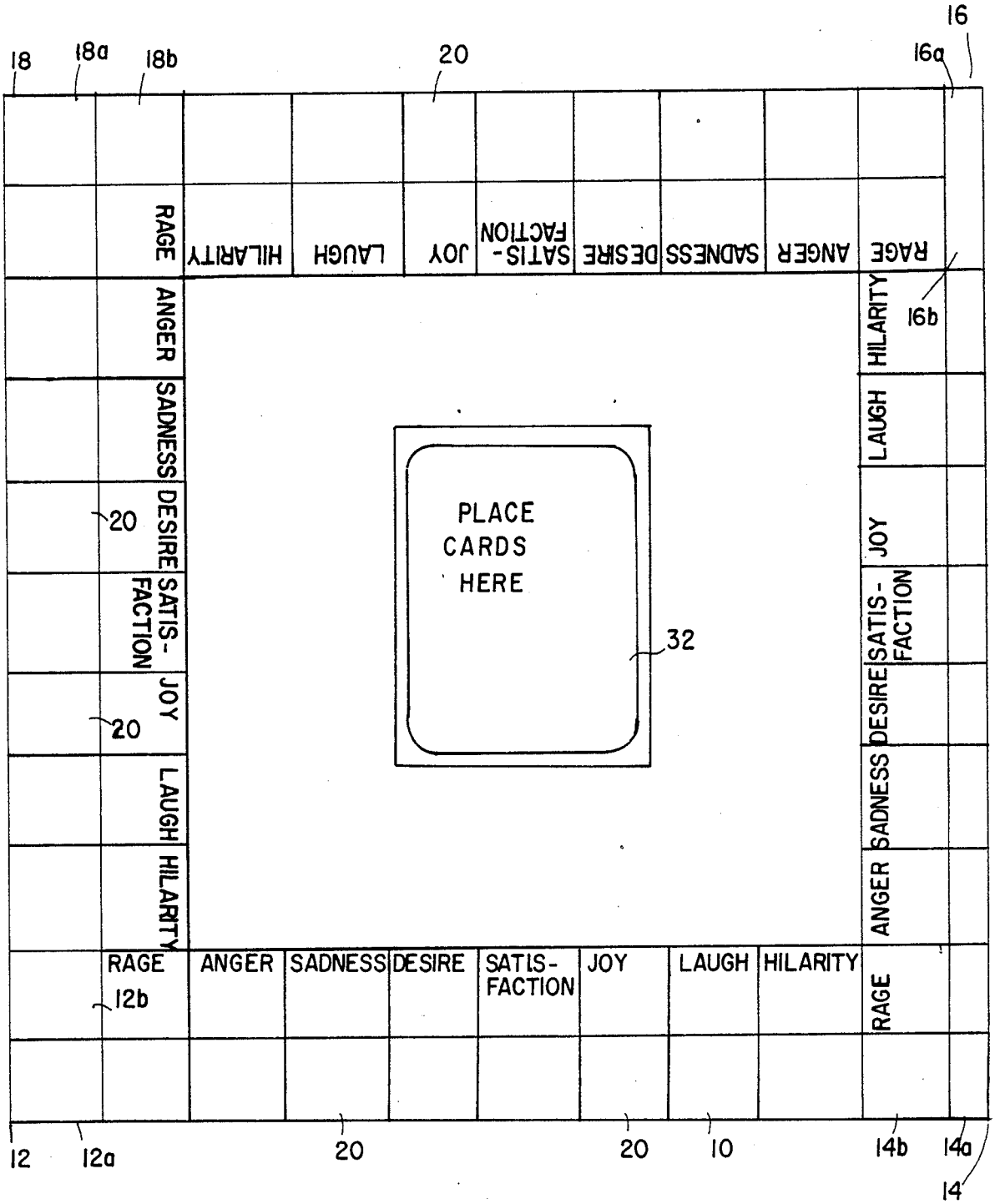
FIG. 1 is a plan view of a game board useful in playing a game according to the teachings of the invention.
Figure 6A:
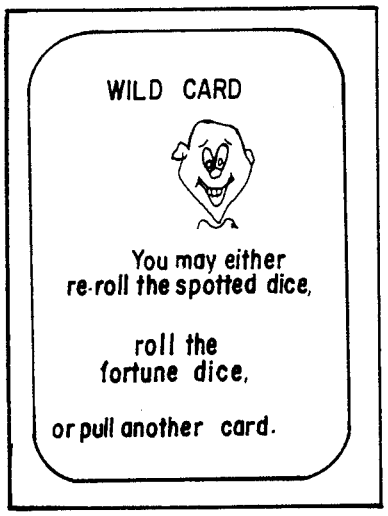
FIGS. 6A–6F show various cards that can be employed with the FIG. 1 game board.
Figure 6B:
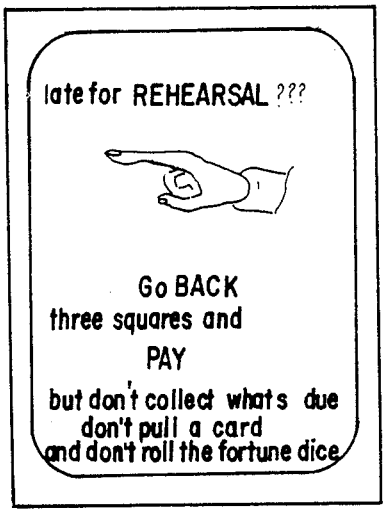
Figure 6C:
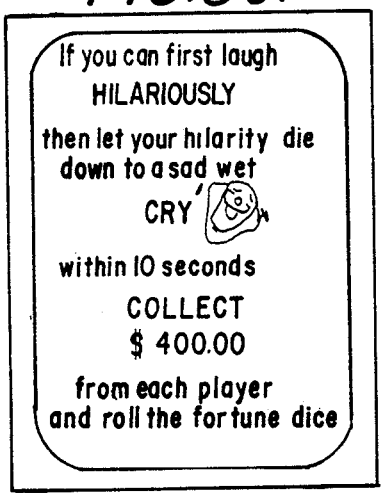
Figure 6D:
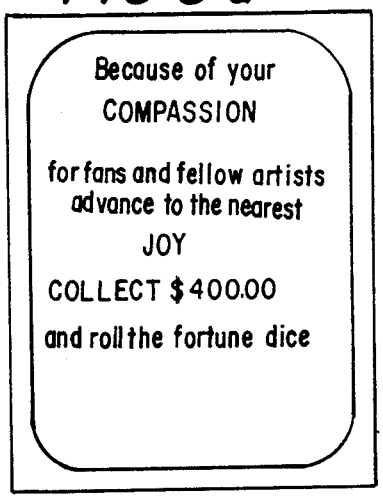
Figure 6E:
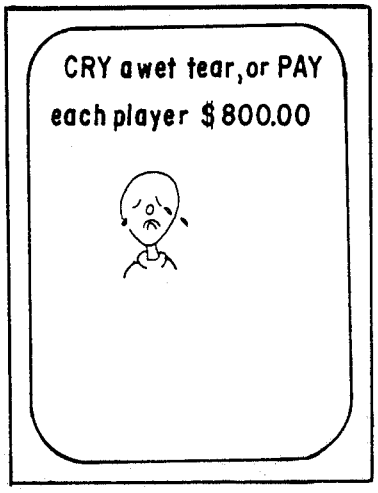
Figure 6F:
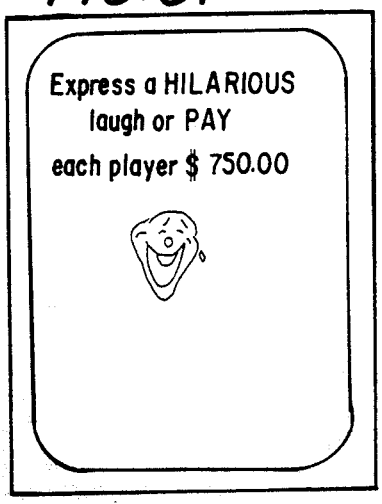
Figure 7A:
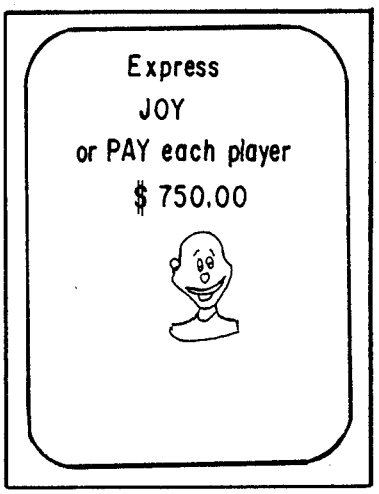
FIGS. 7A–7F show additional representative cards that can be used when playing the game.
Figure 7B:
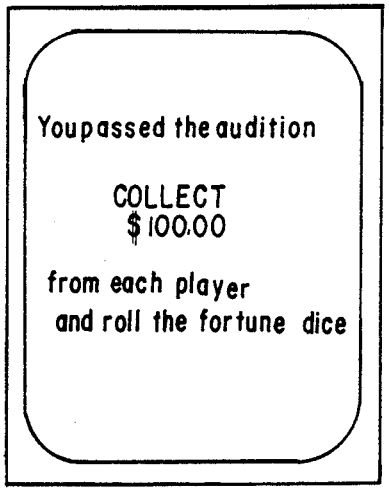
Figure 7C:
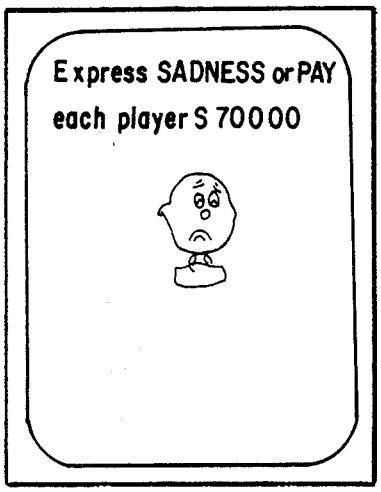
Figure 7D:
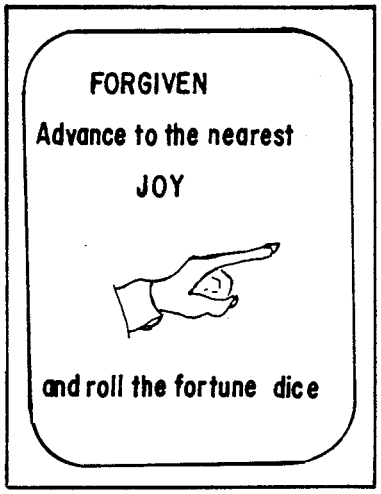
Figure 7E:
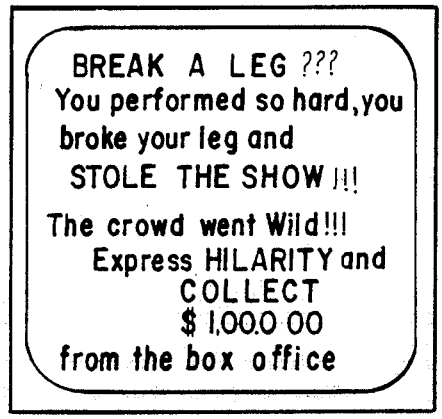
Figure 7F:
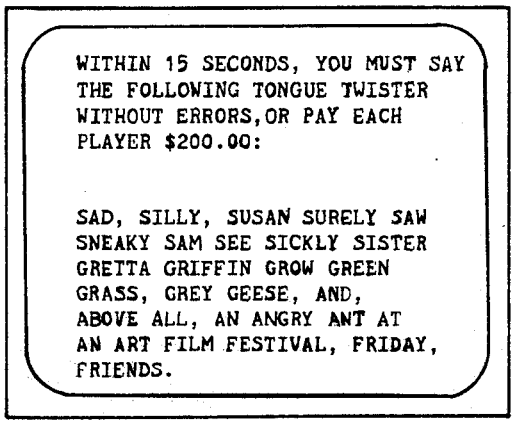

FIG. 1 shows a game board 10 that can be used in playing a game according to the invention. The right side edge area of the board is not shown due to size limitations. The actual board will be square in plan configuration. Typically the board will be approximately about sixteen inches along each of the four side edges.

The four corner zones 12, 14, 16, and 18 of the board are each subdivided into a "start" space and a "finish" space. Each start space is referenced by the numeral **12*a*, 14*a*, 16*a*, or 18*a*; each finish space is referenced by the numeral 12*b*, 14*b*, 16*b* or 18*b***.

The game may be played by as many as four players or as few as two players. Each player receives a player-position identifier piece of the type shown in FIG. 5. Each position identifier piece (token) 22 is placed on one of the "start" spaces **12*a*, 14*a*, 16*a*, or 18*a*, and advanced counterclockwise around board 10. The board is subdivided along each side edge into a number of player position spaces 20. As shown in FIG. 1, the board has eight such spaces 20 along each of its side edges; thus there are a total of thirty-two player position spaces 20. Additionally, each corner zone contains two additional spaces (i.e. a "start" space and a "finish" space). Therefore, there are a total of forty spaces on the board adapted to receive a player-position identifier piece 22. The term "player-position identifier piece" merely references the position of a player on the board relative to his/her starting space and finishing space. As previously noted, each player starts from a different corner of the board. Each player moves his position identifier piece 22 counter clockwise around the board circumference to finish at the corner where he started. When one player has advanced his/her piece 22 to his/her "finish" space, the game is ended. The various pieces 22 are distinctively colored, e.g. pink, yellow, brown, and purple, so that each player can distinguish his/her piece from the other pieces on the board. The players take turns moving their respective position-identifier pieces 22 around the board. The number of spaces that the respective piece 22 is moved during a given turn may be determined by a chance-controlled device such as a die or a spinner device. FIG. 2 shows a conventional die 24 having six faces; each face has a different number of dots thereon, e.g. from one dot up to six dots. The die can be rolled to indicate the number of spaces the player is required to move his/her player-position indicating device 22 along board 10** during one turn.

FIG. 3 shows an alternate chance-controlled device that can be used to determine the number of spaces that each player-position indicating device 22 can be moved during each player's turn. The device shown in FIG. 3 comprises a square piece of cardboard 26 having a manual pointer 28 rotatably mounted thereon at a central point 30. There are markings on the cardboard representing six different numbers. The player manually spins pointer 28 to determine how many spaces he/she will move the respective indicating device 22 during his/her turn.

Figure 8:
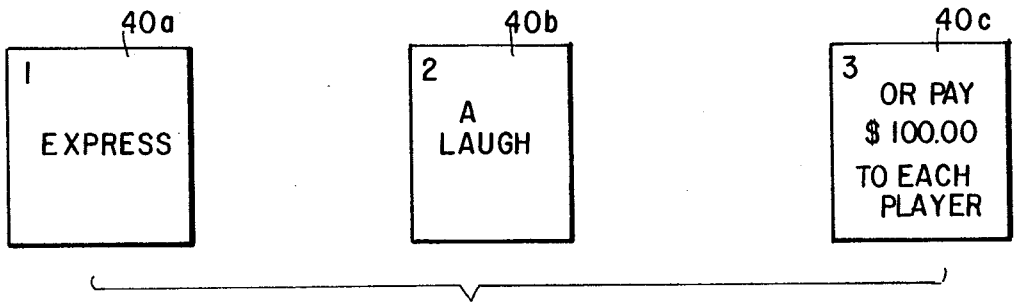
FIG. 8 shows three fortune dice that can be employed when playing the game.

Spaces along each side edge of the board are duplicative of one another, i.e. similarly marked. The first three spaces 20 along each side edge of the board contain the instruction "pull a card"; the last four spaces 20 along each side edge of the board contain the instruction "roll the fortune dice". Representative cards are shown in FIGS. 6 and 7. Three fortune dice are shown in FIG. 8.

The cards are arranged in a stack, face down, on a central zone 32 of board 10 (FIG. 1). When a player's position indicator device lands on a space 20 printed with the "pull a card" marking he/she is required to pull the top card from the pack of cards, and to obey the instructions printed on the pulled card. Many of the cards require the player to perform some activity, or in the alternative pay a designated sum of money to the other players. The activity can e.g. be to "express sadness" or read a tongue-twister expression from the face of the card. The player is given a time limit, e.g. twenty seconds, to successfully perform the designated activity. The other players make the determination whether the effort is successful.

At the start of the game each player is given a designated amount of play money, e.g. $1500. FIG. 4 shows at 36 a representative sample of paper play money that can be use. Also shown in FIG. 4 is a sample of "minus" money 38 that can be used in the playing of the game. During the course of the game players exchange play money, as determined by the instructions on spaces 20 where a player's piece 22 lands, or the instructions on cards pulled from the stack of cards (at 32), or instructions appearing on the fortune dice (FIG. 8). Should a player run out of money, he/she will be issued the appropriate amount of minus money 38 from a bank (or box office). A player out of funds and owing money to one or more other players will have the bank pay the debt; at the same time the bank will deliver to the owing player the appropriate amount of "minus" money 38. Should the player later accumulate money from the other players, the minus money 38 will be deducted from the accumulated monies to determine the player's net accumulation. The winner of the game is the player having the greatest money accumulation, when the game ends, i.e. when one player advances his/her piece 22 to the particular finish space (**12*b*, 14*b*, 16*b* or 18*b*). The person landing his/her piece 22** in the appropriate "finish" space is not necessarily the winner, although he/she can be the winner.

There are three fortune dice **40*a*, 40*b*, and 40*c*; each die has six faces. Markings are printed on the three dice, such that when they are rolled together they can be collectively read to show a particular message. For example, as shown in FIG. 8**, the complete message reads "Express a laugh or pay $100 to each player". Different combinations of words on the three dice produce different messages.

Each face of die **40*a*, has the numeral '1' thereon, indicating that it is to be placed first when reading the message. Each face of die 40*b* has the numeral "2" thereon indicating that it is to be placed second when reading the reading the message. Each die 40*a* contains the initial (opening) phrase of a message. Each die 40*b* contains an intermediate portion of a message. Each die 40*c*** contains the final portion of a message.

Following are wordings that may be used on the six faces of the respective dice.

| On 40a | On 40b | On 40c |
|---|---|---|
| Express | Sadness | And collect $200 from the Box office |
| Express | A smile of joy | Or pay $100 to each player |
| Express | A hilarious laugh | Or pay $100 to each player |
| Do not express | A hilarious laugh | And collect $200 from the box office |
| Express | A laugh | Or pay $100 to each player |
| Express | A tearful cry | Or pay $100 to each player |

The three dice will be rolled together and arranged in a row to produce different messages, according to which face of each dice is facing up. The numerals 1,2 or 3 on the respective dice show the order in which the dice are to be shifted (placed) in order to produce a message.

The use of three fortune dice to produce different messages for different dice combinations is believed to be a unique feature of the game. Another unique feature is believed to be the staggered starting and staggered finishing of the respective pieces 22; each player starts in a different corner and finishes in that same corner. The various pieces 22 are, at any one time, located at different points on the board, such that the players have difficulty in determining who is ahead and who is behind; this feature adds somewhat to a feeling of suspense on the part of the game participants.

As a related feature each "finish" space may be owned by the player seeking to advance his/her piece to that finish space. Should another player land on that particular finish space he can be required to pay the "owner" $2000 (or some other designated dollar amount).

The object of the game is to accumulate the most money. Therefore, a player will not necessarily want to have his/her piece 22 be the first to reach the respective "finish" space. In order to achieve some flexibility in the playing of the game a rule may be established permitting any player to move his piece 22 forwardly or rearwardly (i.e. back toward his/her start space). In order to prevent excessive leeway, this option should not permit rearward movement of the appropriate piece 22 past the start space; i.e. the first move must be in the forward direction.

By permitting a player to move his/her piece 22 forward or backward the game rules permit each player to better control his/her destiny. For example, if a player is nearing his "finish" space and realizes he hasn't accumulated the most money he can reverse the direction of the respective piece 22 on the next move, to thus prolong the game and preserve the possibility of accumulating additional funds.

What is claimed is:

1. A game comprising a square game board having printed markings thereon defining four corner zones, and player position spaces extending along each side edge of the board between the corner zones; each corner zone being subdivided into a start space and a finish space for one player; the four start spaces and four finish spaces being marked so that each player starts from a different corner zone and moves around the circumference of the board to finish at the corner zone where he started; four player-position identifier pieces individually movable from space to space along the board; random number generating means to indicate the number of spaces that a player is required to move his position identifier piece during his turn of play; instructional markings on selected ones of the board spaces: a pack of instruction cards arranged to be individually picked up and read when a player is directed to do so by the instructional markings on the board spaces; and three fortune dice adapted to be rolled to collectively show a message to the players; a first one of said fortune dice having the initial portion of a message printed on each of its faces; a second one of said fortune dice having an intermediate portion of a message printed on each of its faces; and a third one of said fortune dice having an ending portion of a message on each of its faces; said board spaces and instruction cards having instructional markings thereon directing the players to roll the fortune dice when an identifier piece lands on a particular board space, or when a certain card is picked up; and play money passable back and forth between the players according to the directions printed on the board spaces, instruction cards, and fortune dice.

2. The game of claim 1, wherein the game ends when one player moves his identifier piece onto his finish space.

3. The game of claim 2, wherein the winning player is the person having the most money when the game ends.

4. The game of claim 1, wherein the players are permitted to move their identifier pieces forwardly toward the finish space or rearwardly away from the finish space.

5. The game of claim 1, wherein selected ones of said instruction cards have markings thereon directing the player receiving the card to physically express an emotion or alternatively forfeit a specific sum of money.

6. The game of claim 1, wherein said first one of said fortune dice has the numeral 1 on each of its faces indicating that it is to be the first portion of the message; and said second one of said fortune dice has the numeral 2 on each of its faces indicating that it is to be the second intermediate portion of the message; and said third one of said fortune dice has the numeral 3 on each of its faces indicating that it is to be the third and final portion of the message.

7. The game of claim 6, wherein the messages depicted on the fortune dice order the player rolling the dice to either pay a designated sum of money to the other players or receive a designated sum of money from the other players.

8. The game of claim 1, wherein selected ones of said instruction cards have markings thereon directing the player receiving the card to read a tongue-twister message from the selected card or alternatively forfeit a specific sum of money.

9. The game of claim 1, wherein said random number generating means is a dice having flat sides thereon marked to indicate numbers of spaces.

* * * * *